US005158058A

United States Patent [19]

Yoshida et al.

[11] Patent Number: 5,158,058

[45] Date of Patent: Oct. 27, 1992

[54] AIR-FUEL RATIO FEEDBACK CONTROL METHOD FOR A MULTI-FUEL INTERNAL COMBUSTION ENGINE

[75] Inventors: Masato Yoshida, Kyoto; Takanao Yokoyama, Kanagawa; Muneyoshi Nanba, Kyoto, all of Japan; Yoshihiko Kato, Novi, Mich.; Kazumasa Iida; Katsuhiko Miyamoto, both of Kyoto, Japan

[73] Assignee: Mitsubishi Jidosha Kogyo Kabushiki Kaisha, Tokyo, Japan

[21] Appl. No.: 793,535

[22] Filed: Nov. 18, 1991

[30] Foreign Application Priority Data

Nov. 20, 1990 [JP] Japan ..... 2-314922

[51] Int. Cl.[5] ..... F02M 51/00

[52] U.S. Cl. ..... 123/434; 123/698; 123/673; 60/274; 60/285

[58] Field of Search ..... 123/434, 489, 672, 698, 123/691, 703, 1 A, 673; 60/274, 276, 277, 284, 285

[56] References Cited

U.S. PATENT DOCUMENTS

| | | | |
|---|---|---|---|
| 4,945,882 | 8/1990 | Brown et al. | 123/489 |
| 4,953,513 | 9/1990 | Sasaki et al. | 123/489 |
| 4,967,714 | 11/1990 | Indae | 123/489 |
| 5,092,123 | 3/1992 | Nada et al. | 60/274 |

*Primary Examiner*—Raymond A. Nelli

[57] ABSTRACT

An air-fuel ratio feedback control method for a multi-fuel internal combustion engine using a dual $O_2$ sensor system is provided, in which the concentration of oxygen in exhaust gas on the upstream side of an exhaust gas purifier is detected, a value corresponding to the detected oxygen concentration is compared with a first target value, and the air-fuel ratio is feedback-controlled in accordance with the result of the comparison. The mixture ratio of at least two fuels is detected, and a second target value is set in accordance with the detected fuel mixture ratio. On the other hand, the concentration of oxygen in the exhaust gas on the downstream side of the exhaust gas purifier is detected, and a value corresponding to the detected downstream-side oxygen concentration is obtained. The first target value is corrected in accordance with the difference between the obtained value and the second target value.

8 Claims, 3 Drawing Sheets

AIR-FUEL RATIO FEEDBACK CONTROL METHOD FOR A MULTI-FUEL INTERNAL COMBUSTION ENGINE

BACKGROUND OF THE INVENTION

1. Field of the Invention

The present invention relates to an air-fuel ratio feedback control method for an internal combustion engine which can be operated with the use of any of at least two fuels, such as a gasoline fuel, alcohol fuel, etc.

2. Description of the Related Art

In consideration of the anticipated exhaustion of petrochemical fuel resources and in order to improve the exhaust gas properties, intense research has recently been made in internal combustion engines which can use a simple gasoline or alcohol fuel or a mixture of these two fuels as their working fuel.

The conventional multi-fuel internal combustion engines are designed so that the amount of fuel supply (injection quantity) is only adjusted in accordance with the mixture ratio of the fuel, and they are basically the same as the conventional gasoline engines with respect to the air-fuel ratio feedback control method and exhaust gas purifier.

For the internal combustion engines using the gasoline fuel, a so-called dual $O_2$ sensor system has been proposed to cope with the regulations on exhaust gas which have been becoming stricter every year. This system includes $O_2$ sensors which are arranged individually on the up- and downstream sides of a catalytic converter in an exhaust passage and used to detect the concentration of oxygen in exhaust gas. Air-fuel ratio feedback control by means of this system is effected by setting a feedback correction factor value KFB, on which the fuel injection quantity depends, in the following manner, for example. If an output voltage $VO_2$ of a front $O_2$ sensor on the upstream side shifts across a reference voltage Vs to the lean side, a proportional term value P is added to the value KFB, and an integral term value $\Delta I$ is added thereafter with every passage of a predetermined time or with every rotation of a crankshaft for a predetermined crank angle. If the output voltage $VO_2$ of the front $O_2$ sensor shifts across the reference voltage Vs to the rich side, on the other hand, the proportional term value P is subtracted from the air-fuel ratio correction factor value KFB, and the integral term value $\Delta I$ is subtracted thereafter with every passage of the predetermined time or with every detection of a predetermined crank angle position signal. In response to an output from a rear $O_2$ sensor on the downstream side, moreover, the value of the reference voltage Vs is adjusted.

This system should be also applied to the multi-fuel internal combustion engines. If the fuel mixture ratio changes, however, the exhaust gas ingredients vary despite the fixed excess air ratio (or air-fuel ratio), so that the value of the output of the rear $O_2$ sensor inevitably changes. Thus, the dual $O_2$ sensor system cannot properly function, so that the air-fuel ratio feedback control cannot be achieved with high accuracy.

SUMMARY OF THE INVENTION

The object of the present invention is to provide an air-fuel ratio feedback control method for a multi-fuel internal combustion engine, in which air-fuel feedback control can be achieved with high accuracy by using the dual $O_2$ sensor system.

According to an embodiment of the present invention, there is provided an air-fuel ratio feedback control method for a multi-fuel internal combustion engine, in which an exhaust gas purifier for removing noxious ingredients from exhaust gas is arranged in an exhaust passage of the engine which can be operated with the use of at least two fuels having known fuel properties or a mixture. The concentration of oxygen in the exhaust gas on the upstream side of the exhaust gas purifier is detected, an oxygen concentration value corresponding to the detected oxygen concentration is compared with a first target value, and an air-fuel ratio is feedback-controlled in accordance with the result of the comparison.

In the air-fuel ratio feedback control method according to the present invention, the mixture ratio of the two or more fuels is detected, and a second target value is set in accordance with the detected fuel mixture ratio. The concentration of oxygen in the exhaust gas on the downstream side of the exhaust gas purifier is detected, a downstream-side oxygen concentration value corresponding to the detected downstream-side oxygen concentration is obtained, and the first target value is corrected in accordance with the difference between the downstream-side oxygen concentration value and the second target value.

According to the air-fuel ratio feedback control method based on the dual $O_2$ sensor system, the air-fuel ratio can be assumed to be feedback-controlled so that the oxygen concentration detected in the exhaust gas on the downstream side of the exhaust gas purifier is approximate to the second target value, by correcting the first target value. In the control method for an embodiment of the present invention, moreover, the second target value is set in accordance with the fuel mixture ratio, so that optimum air-fuel ratio feedback control for the fuel mixture ratio can be effected even though the fuel mixture ratio varies.

The above and other objects, features, and advantages of the invention will be more apparent from the ensuing detailed description taken in connection with the accompanying drawings.

DETAILED DESCRIPTION OF THE PREFERRED EMBODIMENT

Figure 1:
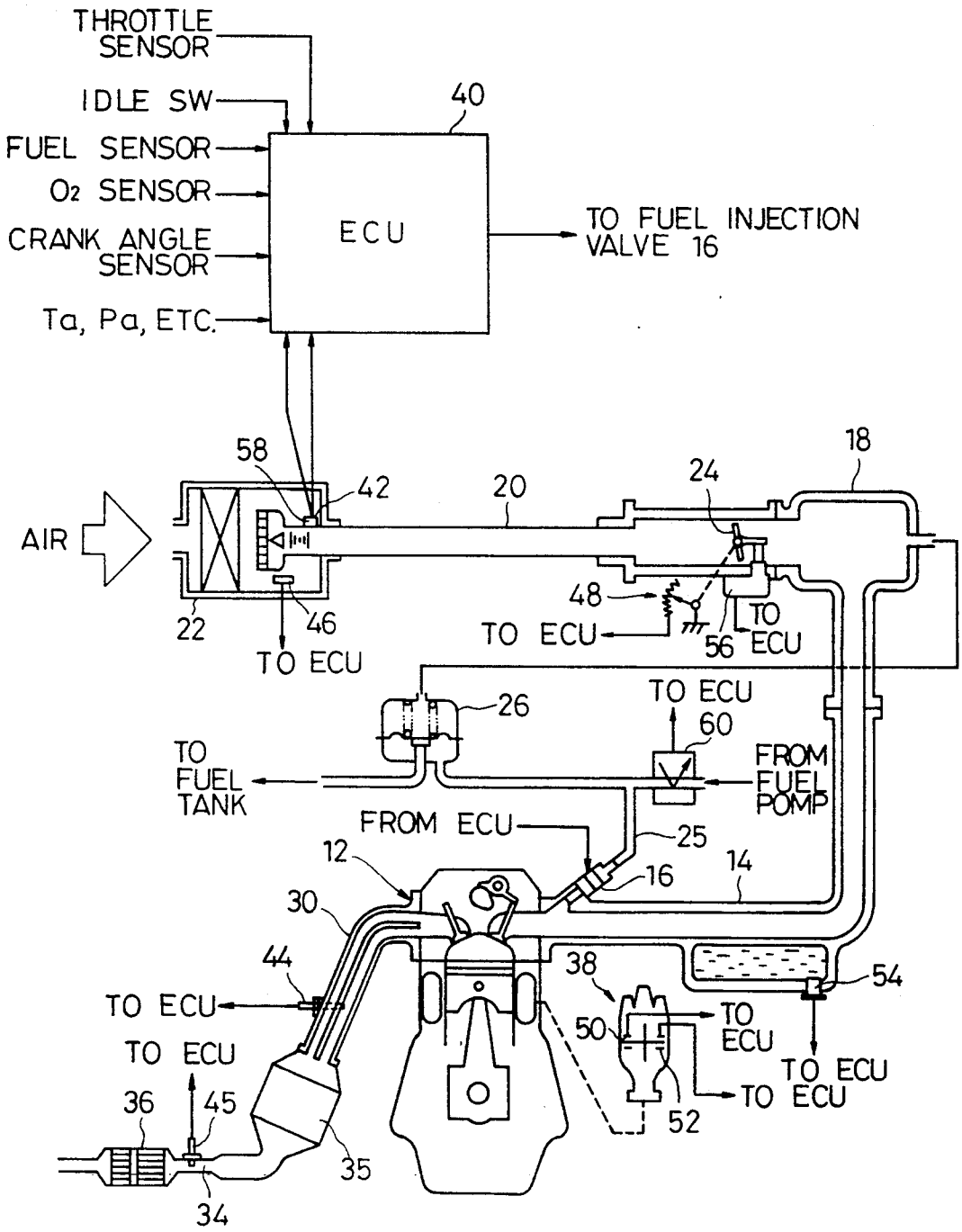
FIG. 1 is a block diagram showing an outline of a fuel supply control apparatus for carrying out a method according to an embodiment of the present invention.

FIG. 1 shows an outline of a fuel supply control apparatus for an internal combustion engine to which a method according to an embodiment of the present invention is applied. This control apparatus is applied to, for example, a four-cylinder gasoline engine (hereinafter referred to simply as "engine") 12. The engine 12 may be operated by using a simple gasoline or alcohol (e.g., methanol) fuel or a mixture of these two fuels in an optional mixture ratio.

Each of intake manifolds 14, which are connected to the individual cylinders of the engine 12, is provided with a solenoid-operated fuel injection valve 16, which is located adjacent to each suction port. One end of a intake pipe 20 is connected to the intake manifold 14 through a surge tank 18, and an air cleaner 22 is attached to the other end (atmosphere-side open end) of the intake pipe 20. A throttle valve 24 is arranged in the middle of the intake pipe 20. Each fuel injection valve 16 is supplied with a fuel, whose pressure is adjusted to a constant level by means of a fuel pressure regulator 26, from a fuel pump (not shown) through a fuel pipe 25.

A fuel sensor 60 is arranged in the middle of the fuel pipe 25. The fuel sensor 60 is used to detect the mixture ratio of the mixed fuel supplied to the fuel injection valve 16. The fuel sensor 60 detects the mixture ratio between the gasoline and alcohol fuels by measuring the values of specific physical properties of the fuel, e.g., dielectric constant, optical refractive index, acoustic velocity, etc. Actually, the fuel sensor 60 is connected electrically to the input side of an electronic control unit (ECU) 40. When a voltage value VB from the fuel sensor 60 is supplied to the ECU 40, corresponding to the aforesaid specific property values, the ECU 40 estimates the fuel mixture ratio B from the value VB. A mixture ratio of 0% indicates use of the 100% gasoline fuel, while a mixture ratio of 100% indicates use of the 100% alcohol fuel.

An exhaust manifold 30 is connected to the exhaust side of each cylinder of the engine 12, and the atmosphere-side end of the manifold 30 is connected to an exhaust pipe 34. Two catalytic converters 35 and 36 of a ternary-catalyst type as exhaust gas purifiers are arranged in the middle of the exhaust pipe 34. The upstream catalytic converter 35 is situated in the vicinity of the atmosphere-side end of the exhaust manifold 30, that is, near each exhaust port of the engine 12. Thus, the upstream catalytic converter 35 is exposed to high-temperature exhaust gas, so that the upstream catalytic converter 35 can quickly finish activation after the start of the engine 12, and is called a warm-up catalytic converter (W/U converter). The downstream catalytic converter 36, which is located on the downstream-side of the W/U converter 35, performs activation more slowly. Once the activation is completed, however, the downstream catalytic converter 36 is maintained by means of the W/U converter 35, and nitrogen oxides and carbon monoxide in the exhaust gas having failed to be purified by means of the W/U converter 35 are more thoroughly reduced and oxidized, respectively.

The exhaust manifold 30 on the upstream side of the W/U converter 35 is fitted with a front $O_2$ sensor 44 for detecting the amount of oxygen in the exhaust gas from the engine 12. Further, a rear $O_2$ sensor 45 for detecting the oxygen concentration of the exhaust gas from the W/U converter 35 is mounted between the two catalytic converters 35 and 36. The front and rear $O_2$ sensors 44 and 45 are each provided with a heater for keeping their sensing sections at high temperatures. The front and rear $O_2$ sensors 44 and 45, which are connected electrically to the input side of the ECU 40, supply the ECU 40 with their respective oxygen concentration detection signals.

The ECU 40 includes a central processing unit (not shown), memories for storing control programs used to calculate the amount of fuel supply, various program variables, etc., and input and output devices. The memories include a nonvolatile battery backup RAM for storing a fuel mixture ratio correction factor value KB, integral correction value Vi, etc. (mentioned later) even after the engine 12 is stopped, as well as a ROM and a RAM.

The individual fuel injection valves 16, which are connected electrically to the output side of the ECU 40, are opened in response to drive signals from the ECU 40, so that each cylinder is supplied with a required amount of fuel by injection, which will be described in detail later. The input side of the ECU 40 is connected with various sensors for detecting the operating conditions of the engine 12, besides the aforesaid front and rear $O_2$ sensors 44 and 45 and fuel sensor 60. These various sensors include, for example, an airflow sensor 42, a suction air temperature sensor 46, a throttle opening sensor 48, a crank angle sensor 50, a cylinder discriminating sensor 52, a water temperature sensor 54, an idle switch 56, an atmospheric pressure sensor 58, an air conditioner switch (not shown), and a battery sensor (not shown).

The airflow sensor 42, which is attached the atmosphere-side open end portion of the intake pipe 20, detects a Karman trail and delivers frequency pulses f which are proportional to the amount of suction air. The suction air temperature sensor 46, which is disposed in the air cleaner 22, detects a suction air temperature Ta. The throttle opening sensor 48 detects the valve opening of the throttle valve 24. The crank angle sensor 50, which is attached to a distributor 38 connected to a camshaft, delivers a pulse signal (TDC signal) every time the crank angle sensor 50 detects the top dead point or a predetermined crank angle position just short of it. The cylinder discriminating sensor 52, which is also attached to the distributor 38, detects that a specific cylinder (e.g., first cylinder) is in the predetermined crank angle position (e.g., top dead point of compression or angular position just short of it). The water temperature sensor 54 detects the cooling water temperature of the engine 12, the idle switch 56 detects the fully-closed position of the throttle valve 24, and the atmospheric pressure sensor 58 detects the atmospheric pressure. Further, the air conditioner switch and the battery sensor are used to detect the operating state of an air conditioner (not shown) and the battery voltage, respectively. These sensors supply their respective detection signals to the ECU 40.

The ECU 40 calculates a fuel injection quantity corresponding to the engine operating conditions, that is, calculates a valve opening time $T_{INJ}$ of each fuel injection valve 16, in response to the detection signals from the aforementioned various sensors. Then, the ECU 40 supplies each fuel injection valve 16 with a driving signal corresponding to the calculated valve opening time $T_{INJ}$, thereby opening the valve, and supplying each cylinder with the required amount of fuel by injection. The ECU 40 calculates the valve opening time $T_{INJ}$ according to equation (1) as follows:

$$T_{INJ} = TB \times KAF \times KB \times K + TD \quad (1)$$

Here TB is a basic valve opening time set on the basis of the gasoline fuel and in accordance with a suction air amount per rotational velocity (A/N), and KAF is an air-fuel ratio correction factor, which will be described in detail later. Further, KB is the fuel mixture ratio correction factor, which is adjusted to a value corresponding to the fuel mixture ratio B. The basic valve opening time TB based on the gasoline fuel is converted into a value corresponding to the fuel in the detected mixture ratio B by being multiplied by the correction factor KB. K is another correction factor which is set in accordance with, for example, a cooling water temperature correction factor KTw set in accordance with the cooling water temperature Tw, a suction air temperature correction factor KTa set in accordance with the suction air temperature Ta, an atmospheric pressure correction factor KPa set in accordance with the atmospheric pressure Pa, etc. TD is a reactive time correction value set in accordance with the battery voltage. A detailed description of the method of calculating these correction factor values and the correction value is omitted herein.

Since the ECU 40 delivers a TDC signal every time the crank angle sensor 50 detects a crank angle of 180°, the engine speed Ne can be detected from the pulse generation interval of the TDC signal. Further, the ECU 40 is stored with the firing order or fuel supply order for the individual cylinders, and can discriminate the cylinder to be supplied next with the fuel by detecting the predetermined crank angle position of the aforesaid cylinder.

The following is a description of the procedure for air-fuel ratio feedback control by means of the ECU 40. Before starting the air-fuel ratio feedback control by means of the ECU 40, it is necessary to simultaneously fulfill requirements that the front and rear $O_2$ sensors 44 and 45 are fully activated, the engine 12 is in a warming-up state, and a predetermined time has been passed after the start of the engine 12, for example. Further, the ECU 40 has previously read various operating condition values necessary for the execution of the air-fuel ratio feedback control. The read operating conditions include a fuel property value signal VB from the fuel sensor 60 as well as the cooling water temperature signal Tw from the water temperature sensor 54, suction air temperature signal Ta from the suction air temperature sensor 46, atmospheric pressure signal Pa from the atmospheric pressure sensor 58, and throttle opening signal $\theta$th from the throttle opening sensor 48. The signals from these sensors are subjected to amplification, filtering, A/D conversion, etc. by means of an input device (not shown), and are read as digital signals by the ECU 40.

Figure 2:
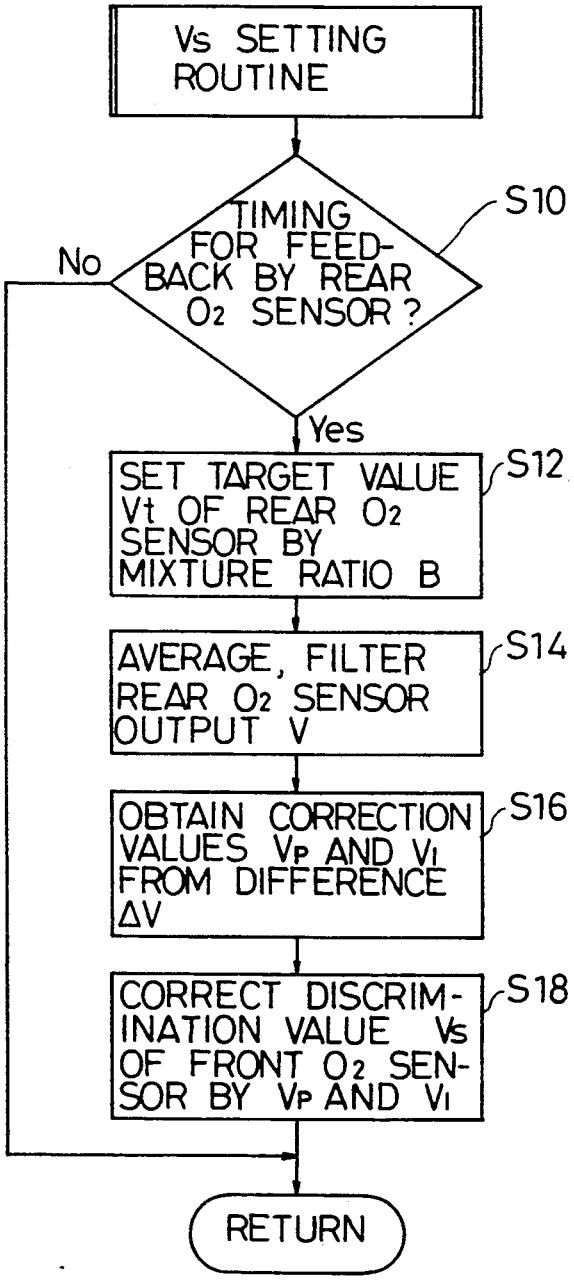
FIG. 2 is a flow chart showing a routine for setting an output discrimination value Vs of a front $O_2$ sensor.

Referring first to FIG. 2, a routine for setting a discrimination value Vs as a first target value used in an injection valve drive routine (mentioned later) will be described. In the routine shown in FIG. 2, the discrimination value Vs is set at an optimum value in accordance with the oxygen concentration detected by means of the rear $O_2$ sensor 45 and the fuel mixture ratio B detected by means of the fuel sensor 60.

In the setting routine for the discrimination value Vs, which is executed at all times, it is determined whether or not it is the time for feedback by means of the rear $O_2$ sensor 45 (Step S10). If it is not the time for the feedback, that is, if the decision in Step S10 is NO, the present routine is finished at once.

Whether or not it is the time for the feedback may be determined with every feedback correction period Ts, set corresponding to the amount of suction air, by determining whether or not the period Ts has passed, for example. The feedback correction period Ts is set according to equation (F1) as follows:

$$Ts = Ks/f, \quad \text{(F1)}$$

where Ks is a constant, and f is a Karman trail generating frequency detected by means of the airflow sensor 42.

Figure 3:
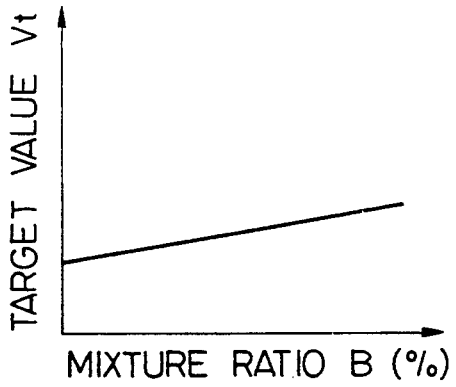
FIG. 3 is a graph showing the relationship between a mixture ratio B and a target value Vt.

If the decision in Step S10 is YES, that is, if it is concluded that it is the time for the feedback, the program proceeds to Step S12, whereupon an output target value (second target value) Vt of the rear $O_2$ sensor 45 is set in accordance with the mixture ratio B detected by means of the fuel sensor 60. FIG. 3, which illustrates the relationship between the mixture ratio B (%) and the target value Vt (voltage value) set corresponding thereto, indicates that the higher the fuel mixture ratio B, the greater the value Vt is.

Subsequently, the program proceeds to Step S14, whereupon an output value V of the rear $O_2$ sensor 45 is read, averaged, and filtered. The output value of the sensor 45 continually varies, and one sampled value is subject to a substantial measurement error. Therefore, n number of sampled data, e.g., five data, are read, and an arithmetic mean Vav of these values is obtained. The mean value Vav obtained in the present cycle is further filtered according to equation (F2) to obtain a filtered value Vf as follows:

$$Vf = Kf \times Vav + (1 - Kf) \times Vf_{n-1}, \quad \text{(F2)}$$

where Kf is a filtering constant, and $Vf_{n-1}$ is a preceding version of the filtered value Vf.

Subsequently, the ECU 40 calculates a proportional correction value Vp and an integral correction value Vi from the difference $\Delta V$ ($= Vf - Vt$) between the filtered value Vf obtained in the aforesaid manner and the target value Vt, according to equations (F3) and (F4) as follows (Step S16):

$$Vp = \Delta V \times Gp, \quad \text{(F3)}$$

$$Vi = Vi_{n-1} + \Delta V \times Gi, \quad \text{(F4)}$$

where Gp and Gi are a proportional correction gain and an integral correction gain, respectively, both of which are positive values. $Vi_{n-1}$ is a preceding version of the integral correction value Vi.

The discrimination value Vs is calculated by substituting the proportional and integral correction values Vp and Vi, obtained in this manner, for the right member of equation (F5) (Step S18), whereupon the present routine ends $$Vs = Vo + Vp + Vi, \quad \text{(F5)}$$

where Vo is a reference value of the output discrimination level of the front $O_2$ sensor 44. Thus, the output discrimination value Vs of the front $O_2$ sensor 44 is corrected by means of the full mixture ratio B and the output value V of the rear $O_2$ sensor 45 with every feedback correction period Ts.

Figure 4:
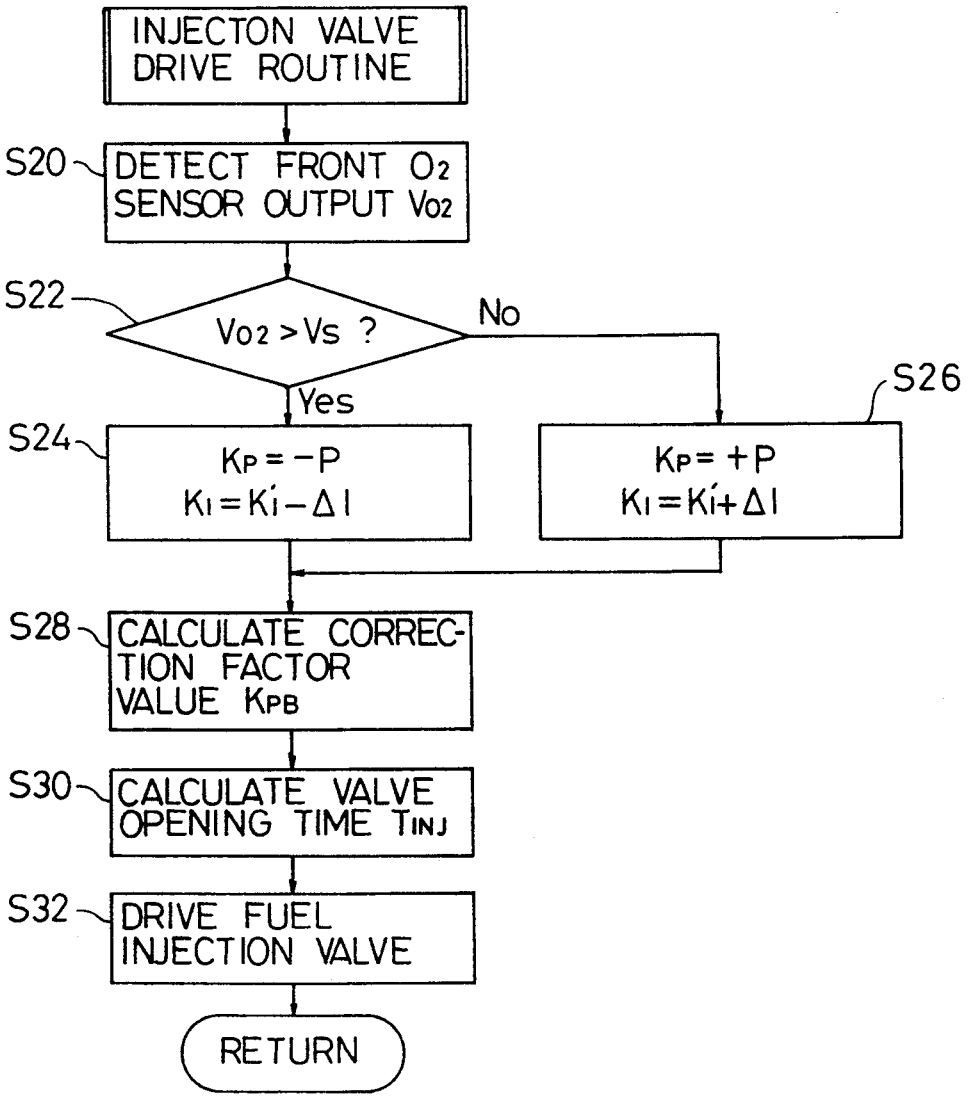
FIG. 4 is a flow chart showing an injection valve drive routine.

FIG. 4 shows the injection valve drive routine which is executed every time a crank pulse signal from the crank angle sensor 50 is inputted. When a crank pulse interruption is made, the ECU 40 first reads a detection signal value $VO_2$ of the front $O_2$ sensor 44 (Step S20). This value $VO_2$ is compared with the discrimination value Vs corrected in the aforesaid manner, and it is determined whether or not the former signal is greater than the latter signal (Step S22). If the signal value $VO_2$ of the front $O_2$ sensor 4 is greater than the discrimination value Vs (decision is YES), that is, if the value of the air-fuel ratio of the mixture supplied to the engine 12 is on the fuel-rich side of the value of the theoretical air-fuel ratio, the program proceeds to Step S24, whereupon a proportional gain term Kp and an integral gain term Ki of a feedback correction factor are calculated according to equations (A1) and (A2) as follows:

$$Kp = -P, \quad (A1)$$

$$Ki = Ki' - \Delta I, \quad (A2)$$

where P is a fixed proportional gain value, ΔI is a fixed integral gain value, and Ki' is a preceding value of the integral gain term. The integral gain term Ki is stored in the aforesaid backup RAM.

If the decision in Step S22 is NO, that is, if the value of the air-fuel ratio of the mixture supplied to the engine 12 is on the fuel-lean side of the value of the theoretical air-fuel ratio, on the other hand, the program proceeds to Step S26, whereupon the proportional and integral gain terms Kp and Ki of the feedback correction factor are calculated according to equations (A3) and (A4) as follows:

$$Kp = +P, \quad (A3)$$

$$Ki = Ki' + \Delta I \quad (A4).$$

When the calculation of the proportional and integral gain terms Kp and Ki is completed, the program proceeds to Step S28, whereupon a feedback correction factor value KFB is calculated according to equation (A5) as follows:

$$KFB = Kp + Ki \quad (A5).$$

The valve opening time $T_{INJ}$ of the fuel injection valves 16 is calculated by substituting the feedback correction factor value KFB, calculated in this manner, for the right member of equation (1) (Step S30). The calculated valve opening time $T_{INJ}$ is set in an injection timer, and a driving signal is delivered, for a period of time corresponding to the time $T_{INJ}$, to the fuel injection valve 16 corresponding to the cylinder to be supplied with the fuel for the loop of the present cycle (Step S32). Thus, an amount of fuel corresponding to the valve opening time $T_{INJ}$ calculated in the aforesaid manner is supplied to the engine 12 by injection.

In the fuel supply control apparatus according to the embodiment described above, the fuel is supplied from the fuel injection valves, arranged individually for the cylinders, to the cylinders by injection. The method of the present invention may, however, be also applied to a fuel supply control apparatus of a so-called single-point type, in which the fuel is supplied to the engine from a single fuel injection valve arranged on the upstream side of a throttle valve, or to a fuel supply control apparatus of an electronic carburetor type.

Further, the air-fuel ratio feedback control method for a multi-fuel internal combustion engine according to the present invention is not limited to internal combustion engines which use a mixture of gasoline and alcohol fuels, and may be also applied to multi-fuel internal combustion engines which use at least two mixed fuels having known fuel properties.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An air-fuel ratio feedback control method for a multi-fuel internal combustion engine, in which an exhaust gas purifier for removing noxious ingredients from exhaust gas is arranged in an exhaust passage of the engine which can be operated with the use of at least two fuels having known fuel properties or a mixture thereof, the concentration of oxygen in the exhaust gas on the upstream side of said exhaust gas purifier is detected, an oxygen concentration value corresponding to the detected oxygen concentration is compared with a first target value, and an air-fuel ratio is feedback-controlled in accordance with the result of the comparison, comprising steps of:

detecting a fuel mixture ratio of said at least two fuels;

setting a second target value in accordance with the detected fuel mixture ratio;

detecting the concentration of oxygen in the exhaust gas on the downstream side of said exhaust gas purifier and obtaining a downstream-side oxygen concentration value corresponding to the detected downstream-side oxygen concentration; and correcting said first target value in accordance with the difference between said downstream-side oxygen concentration value corresponding to the downstream-side oxygen concentration and said target value.

2. An air-fuel ratio feedback control method according to claim 1, wherein said downstream-side oxygen concentration value corresponding to the downstream-side oxygen concentration is obtained from an average of values obtained by sampling the concentration of oxygen in the exhaust gas on the downstream side of said exhaust gas purifier for a plurality of times.

3. An air-fuel ratio feedback control method according to claim 2, wherein said average is obtained from a plurality of oxygen concentration values sampled during one feedback correction period.

4. An air-fuel ratio feedback control method according to claim 2, wherein a present downstream-side oxygen concentration value corresponding to the present downstream-side oxygen concentration is obtained according to the following equation on the basis of said average and a preceding downstream-side oxygen concentration value corresponding to the downstream-side oxygen concentration obtained in the preceding cycle:

$$Vf = Kf \times Vav + (1 - Kf) \times Vf_{n-1},$$

where Kf is a constant smaller than 1 and greater than 0, Vf is said present downstream-side oxygen concentration, Vav is said average and $Vf_{n-1}$ is said preceding downstream-side oxygen concentration.

5. An air-fuel ratio feedback control method according to claim 1, wherein said first target value is corrected in accordance with a proportional correction value and an integral correction value obtained according to the difference between said downstream-side oxygen concentration value and said second target value.

6. An air-fuel ratio feedback control method according to claim 5, wherein said first target value is corrected in accordance with the following equation:

$$Vs = VO + Vp + Vi,$$

where VO is a constant, Vs is said first target value, Vp is said proportional correction value and Vi is said integral correction value.

7. An air-fuel ratio feedback control method according to claim 5, wherein said proportional correction value is obtained according to the following equation:

$$Vp = \Delta V \times Gp,$$

where Gp is a proportional correction constant, Vp is said proportional correction value and ΔV is the difference between said downstream-side oxygen concentration value and said second target value.

8. An air-fuel ratio feedback control method according to claim 5, wherein said integral correction value is obtained according to the following equation:

$$Vi = Vi_{n-1} + \Delta V \times Gi,$$

where Gi is an integral correction constant, Vi is said integral correction value $Vi_{n-1}$ is an integral correction value obtained in the preceding cycle and ΔV is the difference between said downstream-side oxygen concentration value and said second target value.

* * * * *